US005227848A

United States Patent [19]

Robinson et al.

[11] Patent Number: 5,227,848

[45] Date of Patent: Jul. 13, 1993

[54] DEVELOPER FLOW RATE REGULATION FOR AN ELECTROPHOTOGRAPHIC TONING ROLLER

[75] Inventors: Kelly S. Robinson, Fairport; Althea M. Lucas, Rochester; Thomas K. Hilbert, Spencerport, all of N.Y.

[73] Assignee: Eastman Kodak Company, Rochester, N.Y.

[21] Appl. No.: 831,148

[22] Filed: Feb. 4, 1992

[51] Int. Cl.[5] ..... G03G 15/09

[52] U.S. Cl. ..... 355/253; 355/251; 118/657; 118/661

[58] Field of Search ..... 355/245, 251, 253; 118/653, 656, 657, 658, 661

[56] References Cited

U.S. PATENT DOCUMENTS

| | | | |
|---|---|---|---|
| 4,993,356 | 2/1991 | Guslits | 355/251 X |
| 5,065,192 | 11/1991 | Adkins et al. | 355/251 |
| 5,079,590 | 1/1992 | DeCecca | 355/260 |
| 5,095,340 | 3/1992 | Mahoney | 355/251 |

FOREIGN PATENT DOCUMENTS

| | | | |
|---|---|---|---|
| 0133742 | 10/1981 | Japan | 355/251 |
| 0190974 | 11/1982 | Japan | 355/253 |

*Primary Examiner*—A. T. Grimley
*Assistant Examiner*—Matthew S. Smith
*Attorney, Agent, or Firm*—D. Peter Hochberg; Mark Kusner

[57] ABSTRACT

A toning roll assembly in which a rotatable core member with magnetic poles disposed about the periphery thereof is positioned within a hollow shell so that the shell-to-core clearance, and therefore, the magnetic field strength on the outside surface of the shell varies from point-to-point on the shell. Magnetically attractable developer particles are fed onto the shell's surface at a point of higher field strength and moved through a point of lower field strength on the shell. The latter field strength is such so that under the operating and design parameters of the assembly, only the amount of developer required to properly tone the latent image on an associated photoconductor remains magnetically supported on the shell for transport to the photoconductor after the developer passes the point of lower field strength. In one embodiment, the core and shell are rotatable cylinders disposed eccentrically with respect to each other, while in another embodiment the core is a rotatable cylinder and the shell is non-cylindrical and stationary.

15 Claims, 4 Drawing Sheets

DEVELOPER FLOW RATE REGULATION FOR AN ELECTROPHOTOGRAPHIC TONING ROLLER

TECHNICAL FIELD

This invention relates to toner rolls or rollers useful in electrostatographic-type reproduction machines such as printers, copiers, duplicators and the like. More particularly, this invention relates to a method of fabricating and operating toner roll assemblies to provide a more controlled disposition of developer particles on the rollers. Specifically, this invention relates to the control of the design parameters of specially designed toner rollers so that excess developer deposited on the rollers can be separated therefrom in specific amounts, thereby providing a more controlled coating of developer particles on the rolls, and therefore, more desirable tone density and quality for the images produced therefrom.

BACKGROUND ART

Electrostatographic or electrophotographic processes involve a device one of the components of which includes a layer of photoconductive insulating material fixed to a conductive backing, i.e., a "photoconductor". Initially the surface of the photoconductor is uniformly, electrostatically charged over its entire surface, following which it is exposed to a pattern of light corresponding to an image to be reproduced. The charge on the surface areas impacted by the light of the image is thereby dissipated, leaving only areas not so impacted in the initially charged condition. The residual charge remaining on the surface of the photoconductor, therefore, conforms to the configuration of the pattern of light reflected from the image that is to be reproduced.

This latent electrostatic image can subsequently be developed or made visible by exposing it to finely divided, electrostatically attractable, particulate material. The material is drawn or attracted to the surface areas by the electrostatic charge thereon in amounts proportional to the magnitude of the charge in the electrostatically affected areas, thereby forming an image of the material being copied on the photoconductor.

The particulate material used to create the image, referred to in the industry as "toner", typically consists of a pigmented, thermoplastic resinous composition which can subsequently be transferred to a supporting substrate on which the document is to be permanently "fixed". Such transfer can be accomplished, for example, with the assistance of a corona discharge device which results in the creation of an electrostatic charge on the substrate, opposite in nature to the charge of the toner which forms the image on the photoconductor. Transfer of the toner image to the substrate by electrostatic attraction occurs when the substrate and the photoconductor with the image thereon are brought into close proximity with each other. The transferred image can thereafter be permanently fixed to the substrate by fusing the toner composition, using any of the several known methods.

Transfer of the toner to the latent electrostatic image takes place in a "toning zone" in which the photoconductor is brought into contact with a supply of the toner, either in the form of a two component "developer", i.e., magnetic carrier particles coated with toner composition, or in the form of a single component developer, consisting of toner which includes a magnetic component as part of the composition thereof. (Developer, as is used herein, covers the foregoing magnetic material. It does not cover non-magnetic single component developers.) At the point of contact, the developer is carried on a device often termed a "toning roller", and the developer is in motion relative to the photoconductor. The toning roller generally includes a core or roll having magnetic poles on its surface, and a shell in which the core rotates to move developer on the shell. The amount of developer carried on the toning roller at the contact point is of considerable importance in maintaining a high quality image. In this regard, if too little developer is carried on the toning roller, contact between the developer and the electrostatic latent image is reduced, resulting in an image having an undesirably light tone density.. On the other hand, if there is an excess of developer present, such excess is forced outwardly along the longitudinal axis of the toning roller, where it can ultimately be lost from the ends of the roller, resulting in contamination of the electrostatographic device. Furthermore, excess developer can also accumulate at the entrance to the toning zone. This is sometimes called roll-back of the developer. This is undesirable since the area of the photoconductor in contact with the developer gradually increases as a consequence, resulting in a corresponding increase in the time of contact between the latent electrostatic image and the developer. This in turn causes an undesirable increase in the tone density of the image.

The problem described has long been recognized, and several remedial approaches have been suggested in an attempt to overcome it. For example, it has been proposed to use a doctor blade or "feed skive" adjacent to the roller, adjusted to provide just enough clearance between the edge of the skive and the surface of the shell to produce a coating of developer on the roller having the thickness necessary to assure that the toning zone will receive a supply of developer in the correct amount.

A disadvantage of developer flow control achieved through use of a feed skive, however, results from the sensitivity of results to the clearance between the skive and the shell. In this connection, a change of as little as 0.005 inch in the feed gap is capable of varying the tone quality of the image obtained. Proper adjustment of the gap, therefore, can be detrimentally affected by a skive whose surface is not perfectly straight, or by imperfections in the toner roll, for example, its non-circularity in the case of a rotating roll.

Another solution proposed has involved the use of a slotted feed plate positioned between the toner roll and the feed roller supplying it, the amount of developer passing through the slot determining the thickness of the coating on the toner roll, and therefore, the amount of developer available in the toning zone. Again, however, the dimensions are critical, and in this regard, as little as a 0.005 inch change in the slot width, or in the position of the feed plate relative to the toning roller, has a disproportionate influence on image quality.

SUMMARY OF THE INVENTION

In view of the processing, therefore, it is a first aspect of this invention to provide better toned images prepared by electrostatographic-type reproduction devices.

A second aspect of this invention is to provide an improved system for distributing developer particles on toning rollers.

An additional aspect of this invention is to prevent the accumulation of excessive amounts or roll-back of developer particles in the toner application zone.

A further aspect of this invention is to reduce the sensitivity of feed skives optionally placed adjacent to shells to the degree of clearance between the skives and the shells.

Another aspect of this invention is to provide toning rollers that do not require skives to adjust the amount of developer particles on toning rollers.

A still additional aspect of this invention is to provide toning rollers that allow control of the amount of developer particles on the shells through control of the magnetic field affecting the particles.

Yet another aspect of this invention is to provide toning rollers that automatically throw-off unwanted developer particles from shells, thereby providing control of the amount of developer particles on the shells.

The foregoing and additional aspects of the invention are provided in a preferred embodiment of the invention by a product useful in carrying out electrostatographic reproduction procedures in which a rotating cylindrical core provided with a plurality of magnetic poles thereon is mounted within and eccentric to a rotating, hollow cylindrical shell adapted to support magnetically attracted developer on the outside surface thereof. In the product, the degree of eccentricity of the core and shell with respect to each other is varied to adjust the magnetic field strength operative on the surface of the shell, thereby controlling the amount of developer that can be carried thereon to that necessary to provide a properly toned image on an associated photoconductor. The developer is fed onto the shell's surface at a feed zone so that it passes through a clearance point of minimal field strength thereon, at which point developer unsupportable by magnetic attraction is discharged from the shell's surface.

According to another preferred embodiment of the invention useful in carrying out electrostatographic reproduction, a rotating cylindrical core having a plurality of magnetic poles thereon is mounted within a stationary shell whose configuration is controlled through its design so that the clearance between the shell and the core, and therefore, the magnetic field strength operative at the outside surface of the shell, varies depending upon shell location. At least one point of clearance therebetween provides a field strength just sufficient to attract that amount of developer required to produce a properly toned image on the associated photoconductor. The developer is fed onto the shell's surface so that it passes through a point at which excess developer is no longer supportable on the shell's surface, and at that point, the unsupportable, excess developer is removed or discharged from the shell's surface.

The foregoing and further aspects of the invention are provided by a device for carrying out electrostatographic reproductions controlled by processes described in the preceding paragraphs.

BRIEF DESCRIPTION OF THE DRAWINGS

The invention will be better understood when reference is had to the following drawings, in which like-numbers refer to likeparts, and in which.

BEST MODE FOR CARRYING OUT THE INVENTION

Figure 1:
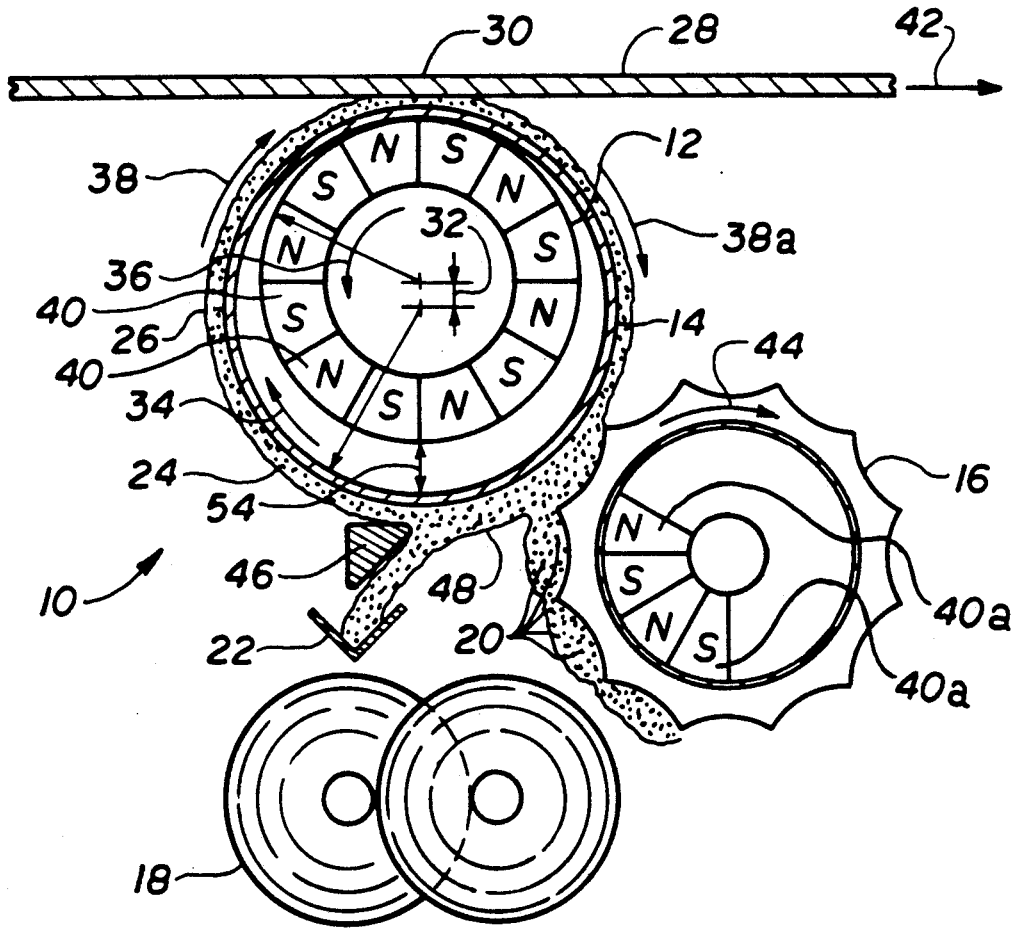
FIG. 1 is a schematic view of an embodiment of the invention employing a rotating toning roll shell in conjunction with an eccentrically positioned, counter-rotating magnetic core.

Toning rollers of the type with which this invention is concerned are provided with an internal rotating core having a plurality of magnetic poles arranged around the perimeted thereof. The core is mounted within a shell, which may be of the rotating or non-rotating type, such that the clearance between the shell and core varies around the periphery of the core. After developer is fed onto the shell, chain-like segments of the magnetically attracted developer particles form on the shell's external surface, extending outwardly therefrom. As the core revolves, the chains pivot about their lower end in the direction of the oncoming magnetic poles, whose field strength effect on the chains is greater due to the reduced clearance, the previously lower end then assuming the outwardly extending position, but in a new location. The sequence described is continually repeated, causing the particle chains to travel or "flow" along the surface of the shell in a "somersault" fashion in the direction of opposite or counter to the direction of core rotation. In this manner the developer particles proceed from the point at which they are fed onto the surface of the shell, to the point where they encounter the photoconductor passing adjacent to the toning roller. At that point the toner carried on the carrier component of the developer is transferred to the conductor, the "depleted" carrier or developer then being carried on the surface of the shell back to a sump for replenishment of its toner coating.

The concept of the invention is to adjust the shell-to-core clearance at a point between the location at which the developer is fed onto the toning roller, and the point where the toner is transferred to the latent electrostatic image on the photoconductor, so that at such clearance point, and under the operating conditions and design of the shell and core assembly, the strength of the magnetic field on the outside of the shell is sufficient to hold only the proper amount of developer on the shell's outer surface. Any excess developer is thrown or discharged from the shell's surface at such point. This controlling clearance point is frequently the point of maximum clearance between the developer feed point or feed zone and the point of toner transfer or toner zone, and is often located near the 6 o'clock position of the shell in the embodiment of the invention involving a rotating shell.

In still another embodiment of the invention, however, the shell is non-circular, and non-rotating; but again is configured to provide at least one point of maximum clearance, and thus a point of minimum flux density at the shell surface between the developer feed zone and the toner zone. In a preferred aspect of this latter embodiment, the stationery shell has two such maximum clearance points. Alternatively, one of these may be even greater then the other, being located after the point of toner transfer, and functioning to assist in the separation of depleted toner carrier or developer from the shell in the process of its return to the sump.

In both the embodiments described, however, it is necessary that the developer particles be fed onto the shell at a point prior to the point of minimal flux density, i.e., the point at which the excess developer is discharged from the shell surface.

FIG. 1 is a schematic view of an embodiment of the invention employing a rotating toning roller shell in conjunction with an eccentrically positioned counter-rotating magnetic core. As shown in the Figure, the toning roller assembly generally 10, comprises a counter-clockwise rotating core 12 having alternating magnetic poles 40 disposed on the surface thereof, located within a clockwise rotating shell 14. The core 12 is positioned eccentrically with respect to shell 14 by distance 32, thereby providing a maximum clearance 54 at the 6 o'clock position of the toning roller assembly. The direction of rotation of the shell and core are shown by associated arrows 34 and 36, respectively.

The developer feed particles 20 are fed from a sump mixer 18 to a fluted developer feed roller 16 which rotates about a plurality of stationary magnetic poles 40*a*. Developer particles are transferred, for instance in a clockwise direction, on feed roller 16 to the outer surface of shell 14 where transfer of the developer to the shell occurs, for example, at the 5 o'clock position of the toning roll assembly. The developer particles thus transferred are carried on the surface of shell 14 through the 6 o'clock position of the toning roller assembly at which point the magnetic field on the exterior surface of the shell is at its weakest relative to the field strength between the feed zone and toner zone of the shell. At this point, the operating and design parameters of the toning roller assembly cause excess developer particles, i.e., those not required for developing the latent image on photoconductor 28, to be discharged or "thrown" from the surface of the shell at the 6 o'clock position, desirably re-entering the developer sump at 22.

The balance of the developer particles are carried on the exterior surface of the shell 14 in the direction of arrow 38. In area 24 of the shell, the coating of developer on the shell tends to comprise relatively widely distributed, long chains of developer particles; however, as the particles progress in a clockwise direction about the surface of the shell, the particles chains shorten and become less distantly spaced from each other, for example, in area 26, thereby producing a more regulated and uniform coating on the shell surface.

At the 12 o'clock position, the toning roller assembly 10 comes into proximity with the photoconductor 28, traveling in the direction of the arrow 42. At the point of proximity, i.e., the toning zone, the toner particles transfer from the shell to the photoconductor.

Although not necessary, if desired, a skive 46 may be located adjacent to the shell 14 after excess developer has been discharged from the shell surface. A notable advantage of the use of a skive following discharge of the excess developer is that back-up control of the developer coating on the surface of shell 14 can thereby be achieved, but without the sensitivity to positioning normally attendant to skive developer control as practiced in the prior art.

The diameter of both the core and shell components of the toning roll assembly can be varied within fairly broad limits; however, due to the convenience resulting from electrostatographic reproductive devices that are compact, the diameters of the components will generally be rather small. In this regard, the diameter of the core will typically be from about ⅜ to 3 inches, while the shell diameter will range from about ½ to about 3½ inches. The eccentricity may also be adjusted within a fairly broad range to provide a desired clearance. The clearance will depend upon interrelated factors such as shell and core speeds, the diameters of the shell and core, the number and strength of magnetic poles positioned on the core, the size of the developer particles and their related characteristics, as well as similar considerations. Typically, however, the eccentricity will be adjusted so that the clearance between the shell and the core at the 6o'clock position of the toning roll assembly will be in the order of about 0.03 to about 0.5 inches. Again, the degree of eccentricity will be selected so that the field strength on the external surface of the shell will be just sufficient given the process operating parameters, component design, and developer characteristics so that the field strength at the external surface of the shell will be just sufficient to support the amount of the developer on the shell surface required to produce properly toned images.

In practice, the field strength acting on the particles at the point of maximum clearance between the core and the shell surface will be in the range of from 50 to about 500 gauss. With respect to field strength, three areas of the shell's external surface are important. The field strength at the 12 o'clock position, where transfer of the developer to the photoconductor takes place will be the strongest, while the surface at the 6 o'clock position will be the weakest. Although the feed point, for example, the 5 o'clock position will often have a field strength weaker than the 12 o'clock position, it will be stronger then that at the 6 o'clock position.

When the relative field strengths are as described, developer can be fed onto the surface of the shell before the shell rotates to the location of its largest clearance relative to the core, i.e., the 6 o'clock position, again where the field strength is the weakest and excess developer is thrown from the shell. The clearance decreases from the 6 o'clock position to the 12 o'clock position, resulting in the field strength increasing throughout that progression, and causing the developer particles to flow upward along the surface of the shell to the point of proximity of the shell with the photoconductor.

With respect to the operating parameters, the speed of a rotating shell will usually range from about 0 to about 200 revolutions per minute, while the rotational speed of the core will commonly be from about 0 to about 3,000 revolutions per minute.

Although the number of poles on the core may vary, typically from about 4 to about 30 will be provided. In this regard, the greater the number of poles present, the less the field strength. Conversely, fewer poles provide a greater field strength; therefore, the fewer the poles present, the faster the roller will be rotated to provide comparable results. The speed of travel of developer about the core surface can be controlled in a variety of ways. For example, while FIG. 1 shows counter-clockwise rotation of the core and clockwise rotation of the shell, and although a more rapid core speed provides more rapid travel of the developer over the shell surface, the shell can also be rotated counter-clockwise to slow the flow of developer over the surface. Alternatively, both the shell and core can be rotated clockwise to achieve the proper speed of developer travel over the shell surface.

At the point of proximity 30 of the shell 14 with the photoconductor 28, the toner composition is electrostatically attracted to the latent image on the photoconductor, the depleted photoconductor thereupon proceeding downwardly in the direction of arrow 38*a* to the region 48 where sufficient mixing of the depleted developer with the fresh material supplied from feed roller 16 takes place to allow image quality to be maintained.

As previously indicated, the use of a skive is not required; however, when used, it will be spaced from the outer surface of the shell by a distance which can range from about 15 mils to about 150 mils. Typically, the space between the shell and the photoconductor will be from about 0 to about 50 mils.

The thickness of the controlled coating of developer on the shell's outer surface will usually be about 8 to about 20 mils, while the density of the coating in the toning zone will often be from about 30 to about 80 milligrams per square centimeter. The diameter of developer carrier particles will frequently be in the order of from about 30 to about 150 microns. Examples of suitable developers, for example, are those described more particularly in U.S. Pat. No. 4,546,060.

Photoconductors of the type contemplated by the invention are commonly fabricated as a plastic web coated with photoconductive material. The speed of the photoconductor past its point of proximity with the toning roller shell will typically be from about 2 to about 30 inches per second, it being desirable to have the photoconductor and shell move either at about the same speed with respect to each other, or within a ratio of no more than about 1:2, shell to photoconductor, or vice versa.

The feed roller 16 of the invention, for example, may have a diameter of about ¾ to about 3 inches, and will be rotated, for instance, at a speed from about 2 to about 2100 revolutions per minute.

Toner roller shells of the type contemplated by the invention will desirably be made from a metal such as aluminum or carbon steel, which may be coated to provide better traction to the particles traveling over the outside surface of the shell and to facilitate their transfer from the shell to the photoconductor.

Figure 2:
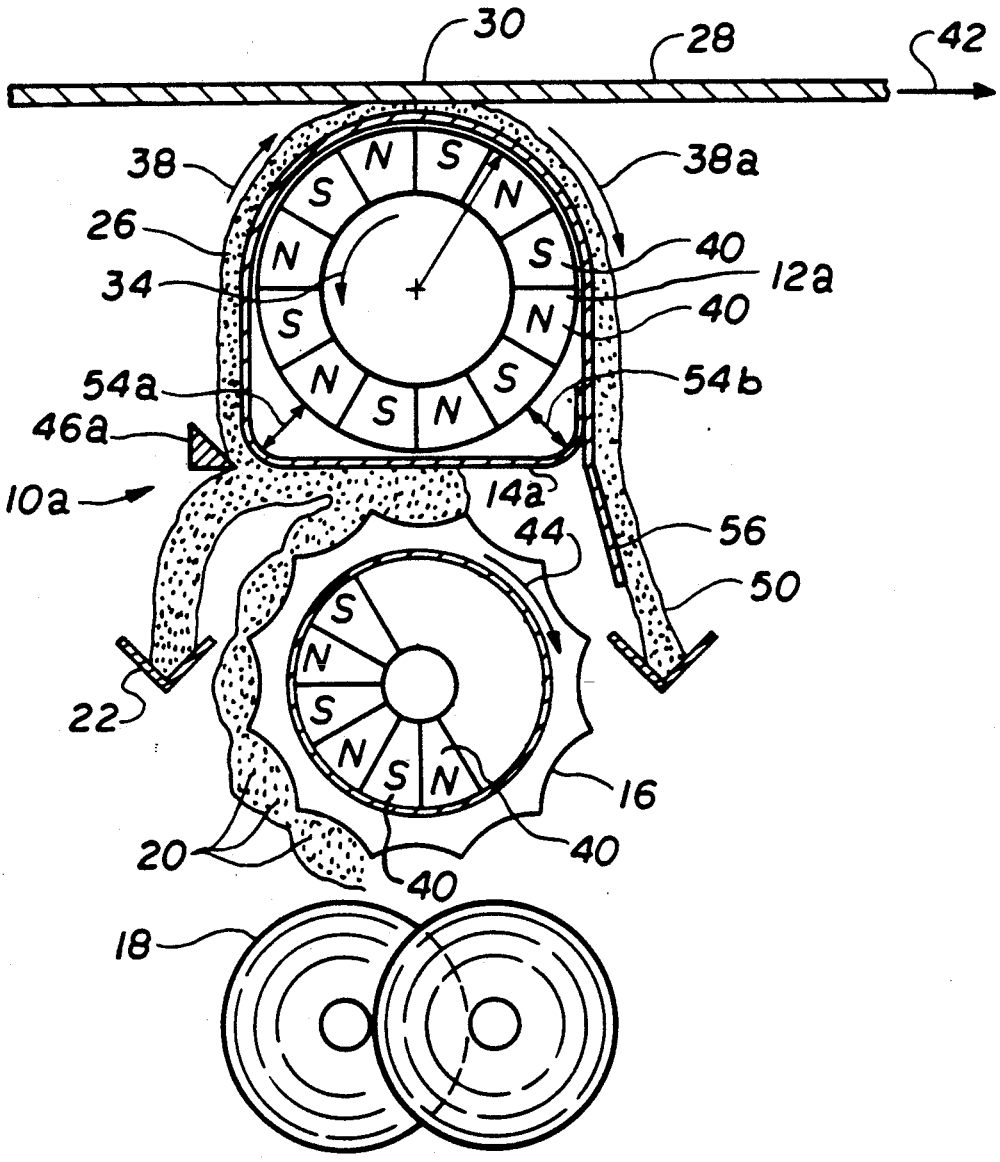
FIG. 2 is a schematic view of another embodiment of the invention employing a rotating magnetic core in a non-rotating, non-circular shell.

FIG. 2 is a schematic view of another embodiment of the invention embodying a rotating magnetic core in a non-rotating, non-circular shell.

Shown in the Figure is a toning roller 12*a*, rotating in a counter-clockwise direction as shown by the arrow 34. The core is mounted on the inside of the stationary toning roller shell 14*a* in such a way that one of two points of maximum clearance between the core and shell is provided at 54*a*. Toning roller 12*a* is provided with a series of alternating magnetic poles around its periphery 40. A fluted developer feed roll 16, which rotates about a stationary magnetic core, carries developer feed particles 20 to the 6 o'clock position of the shell. There the developer feed particles are carried in a clockwise direction as shown by associated arrow 38 over the surface of the shell 14*a*. As the developer feed particles pass the point of maximum clearance 54*a*, the magnetic field strength on the outside of the shell is sufficient only to retain the amount of developer particles thereon required to provide toner to the latent images on photoconductor 28 in the toning zone 30. The excess of the developer particles is thrown from the toning roll assembly at 22. If desired, a skive 46*a* can be provided as a supplemental control for regulating the amount of the developer particles traveling over the surface of the shell 14*a*.

Following transfer of the toner from the developer particles in the toning zone 30, the spent developer 50 proceeds past another point of maximum clearance 54*b* at which it is able to be removed from the outer surface of shell 14*a* due to the weak magnetic field strength at that point, further assisted by the guidance provided with guide baffle 56. After leaving the toning roller assembly 10*a*, the spent developer enters the toner sump where make-up toner is added to the developer with the assistance of sump mixer 18.

While the rotating shell embodiment described in connection with FIG. 1 provides a somewhat better toned image, a stationary shell is somewhat less expensive to fabricate since it may be very inexpensively formed from sheet metal. The operating principle is the same as that of the embodiment of FIG. 1 in that the stationary shell assembly also involves feeding the developer feed particles at a point of magnetic attraction sufficient to retain them, and then passing the particles through a zone in which the magnetic field strength is just sufficient to retain the desired amount of particles on the shell required for image toning in the toner application zone 30.

Figure 3:
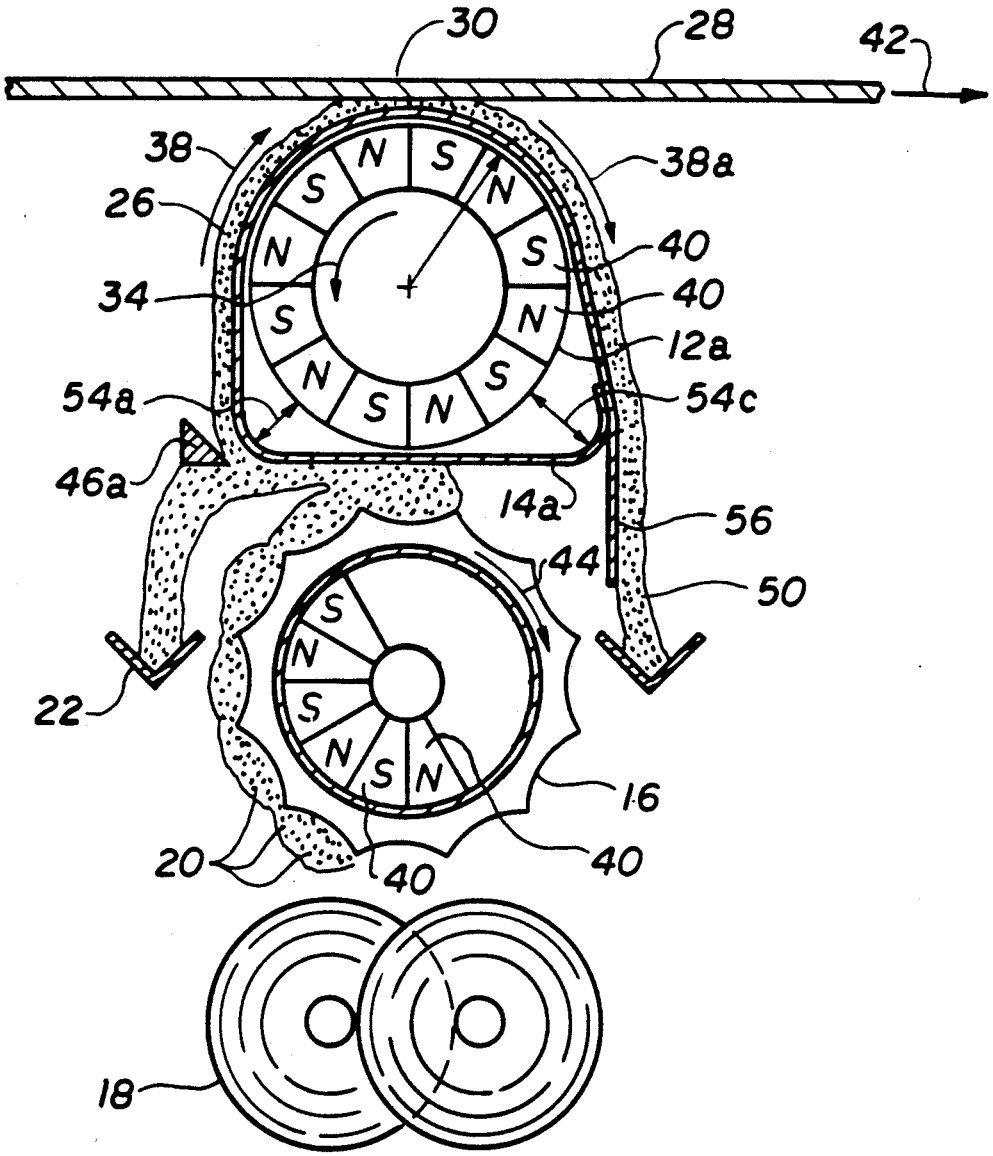
FIG. 3 is a schematic view of yet another embodiment of the invention employing a rotating magnetic core in a non-rotating, non-circular, asymmetrical toning shell.

FIG. 3 is a semi-schematic view of yet another embodiment of the invention employing a rotating magnetic core in a non-rotating, non-circular asymmetrical toning roller shell. The embodiment of FIG. 3 is basically a variation of that shown in FIG. 2. As shown in the Figure, a core 12*a* provided with magnetic poles 40 on the surface thereof is rotated in a counter-clockwise direction as shown by the associated arrow 34 within a shell 14*a*. The shell receives developer feed particles 20 from a fluted developer feed roller 16 which rotates about a stationary magnetic core in a clock-wise direction as shown by associated arrow 44. Again, the developer particles proceed from the feed point to a clearance zone where the clearance 54*a* between the shell and the core is adjusted to provide a field strength sufficient only to retain the developer particles required to provide proper toning of the latent image in the toning zone 30, the particles proceeding over the shell surface in the direction of associated arrows 38. If desired, a skive 46*a* can be provided in further assurance that the amount of developer particles in the regulated zone 26 will be that desired.

In the case of the embodiment of FIG. 3, the depleted developer particles 50 leaving the toning zone pass clearance point 54*c* between the core 12*a* and shell 14*a* that is greater than the clearance provided at 54*a*. The purpose of the larger clearance is to facilitate to an even greater degree the elimination of the spent toning particles 50 over guide baffle 56.

The field strength B at any given point on the shell surface can be designed to a desired value through use of the following formulas:

$$B(r,\theta) = B_s\left(\frac{Rs - e}{r}\right)^{N+1}[V_r\cos(N\theta) + V_\theta\sin(N\theta)]$$

where:

B = the magnetic field strength at any given point on the shell surface.

Bs=magnetic field strength measured at the shell surface at the 12 o'clock position.

Rs=radius of the shell surface.

r=radial distance from the center (spin axis) of the magnetic core.

$\theta$=angle around the roller core, where for $\theta=0°$ is taken to be centered over a N pole at the 12 o'clock position.

N=number of magnet pole pairs (N=2 for a 4 pole roller).

e=roller eccentricity, offset between the spin axis of the roller core and the shell.

$V_r$=unit vector in the radial direction.

$V_\theta$=unit vector in the angular direction.

In an eccentric roller design, where the spin axis of the roller core is offset from the rotational axis of the roller shell, the radial distance (r) between the center of the core and the shell surface varies with the angle ($\theta_s$) around the roller. The controlling equation is:

$$r^2=(R_s+x)^2+e^2-2(R_s+x)\cos\theta_s$$

where:

r=radial distance between the center of the core and the shell surface.

$R_s$=radius of the shell surface.

x=radial distance from the shell surface to the position of the magnetic field measurement probe.

e=roller eccentricity, offset between the spin axis of the roller core and shell.

$\theta_s$=angle around the shell, which is slightly different from the angle $\theta$ around the core, but a good approximation.

EXAMPLE

By way of exemplification of the regulation of developer particles over the exterior shell surface of a toning roll assembly, an assembly is fabricated employing a 12 pole, 834 gauss magnetic core having an outer diameter of 1.225 inches. The core is mounted inside a circular, non-rotating shell having an outer diameter of 1.50 inches and an eccentricity of 0.085 inches, relative to the core. The toning roller assembly described is found to have a field strength of about 160 gauss at the 6 o'clock position, and about 818 gauss at the 12 o'clock position. The shell is hand-loaded with developer particles of the type described in the patent previously referred to, the core thereafter being rotated at various speeds to determine the consistency of developer particle loading retained on the surface of the shell. A number of runs are conducted in accordance with the following:

| Developer (Grams) | Core Speed (RPM) | Developer Retained On Shell Surface | Developer Discharged (Grams) |
|---|---|---|---|
| 18 | 785 | 11.5 | 6.5 |
| 20 | 785 | 11.2 | 8.8 |
| 20 | 785 | 11.4 | 8.6 |
| 20 | 600 | 14 | 6.0 |
| 20 | 600 | 13.8 | 6.2 |
| 20 | 833 | 10.5 | 9.5 |
| 20 | 833 | 10.4 | 9.6 |

Figure 4:
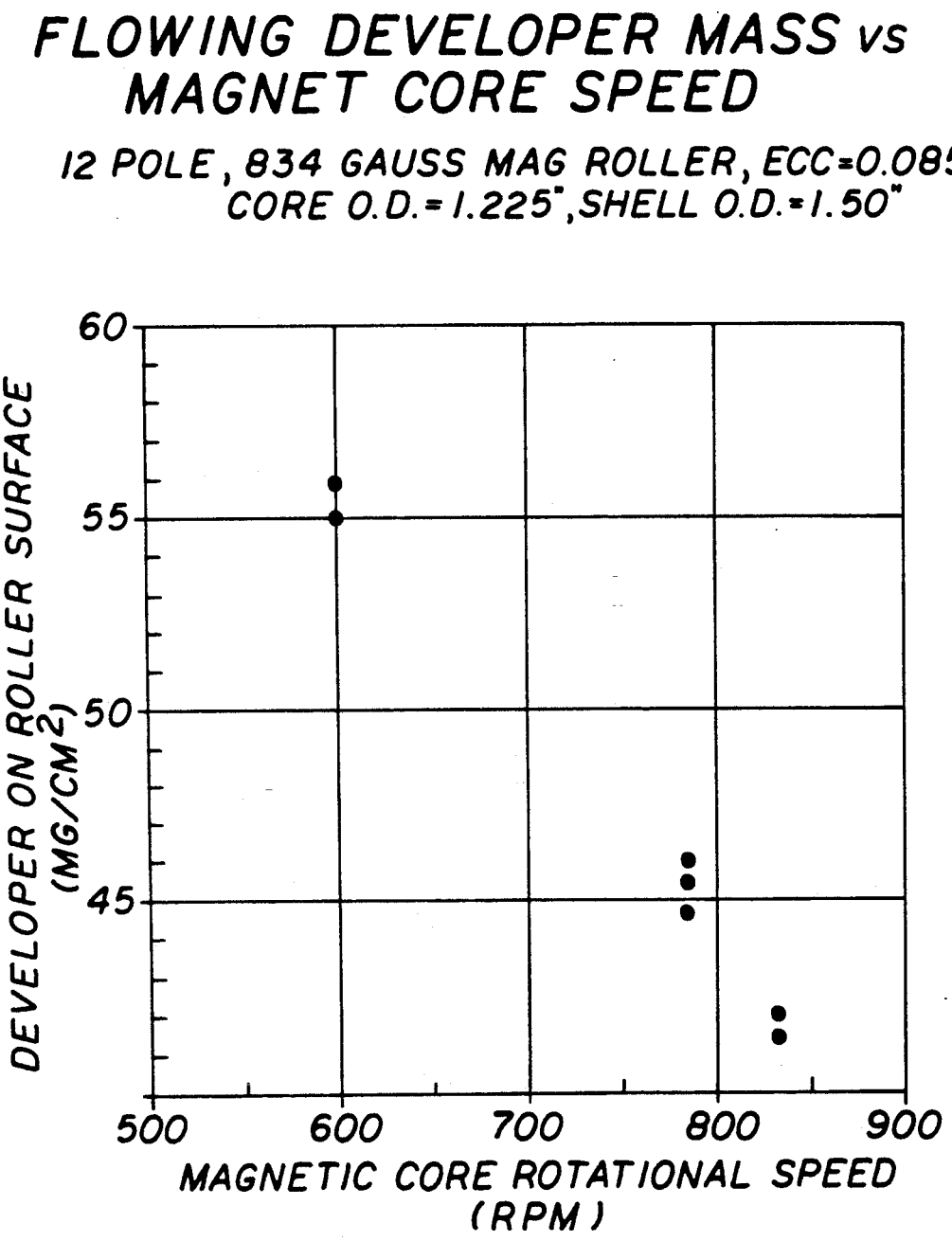
FIG. 4 is a plot of the amount of developer retained on the surface of the shell of an embodiment according to FIG. 1, versus the rotational speed of the magnetic core.

FIG. 4 is a plot of the results shown in the Table, demonstrating that at a given magnetic core rotational speed, the developer retained on the surface is essentially the same, confirming the validity of the inventive concept.

While in accordance with the patent statutes, a preferred embodiment and best mode has been presented, the scope of the invention is not limited thereto, but rather is measured by the scope of the attached claims.

We claim:

1. Apparatus for controlling the developer in an electrostatographic reproduction machine having an electrostatographic image bearing member, to remove excess developer and avoid transfer of an excess amount of toner to the image bearing member and a roll-back of developer at a toning zone; the developer being fed to the apparatus at a feed zone and toner being transferred to the image bearing member in a toning zone, said apparatus comprising:

shell means having an outer surface for supporting developer; and core means mounted for rotation on a rotational axis extending through said shell means, said core means having an outer surface portion with alternating magnetic poles for attracting the developer to the outer surface of said shell means;

wherein the distance from said core means to said shell means is a gap which varies with the angle around said core means, and the magnetic strength of the core means on the shell means varies with said gap, the toning zone occurring where said gap is relatively low and the feed zone occurring where said gap is relatively high; excess developer being discharged from said shell means at a clearance zone where said gap is at its maximum between the feed zone and the toner zone.

2. Apparatus according to claim 1 wherein the toning zone occurs where said gap is at a minimum.

3. Apparatus according to claim 1 wherein the feed zone occurs where said gap is at a maximum value.

4. Apparatus according to claim 1 wherein said shell means and said core means are generally cylindrical, said core means and said shell means being eccentric to establish said gap.

5. Apparatus according to claim 4 wherein said eccentricity can be varied according to changes in operating characteristics of the electrostatographic machine.

6. Apparatus according to claim 4 wherein one of said core means and said shell means rotates clockwise and the other rotates counterclockwise.

7. Apparatus according to claim 4 and further including skive means opposing said outer surface of said shell means at the clearance zone for assisting in the removal of said excess developer.

8. Apparatus according to claim 4 wherein the feed zone is at a 5 o'clock position with respect to the core means, the clearance zone is at a 6 o'clock position and the toner zone is at a 12 o'clock position on the core means.

9. Apparatus according to claim 1 wherein core means is generally cylindrical and said shell means is not cylindrical.

10. Apparatus according to claim 9 and further including means for mixing depleted developer having passed through the toning zone, with toner.

11. Apparatus according to claim 10 and further including removal means for removing spent developer in a removal zone having passed through said toning zone, off said shell means.

12. Apparatus according to claim 11 wherein said removal means is located where said gap is at a maximum value between the toning zone and the feed zone.

13. Apparatus according to claim 12 wherein said gap associated with said removal zone is greater than said gap at said clearance zone.

14. Apparatus according to claim 12 wherein the feed zone is at the 6 o'clock position with respect to the core means, the clearance zone is between the 7 o'clock and the 8 o'clock positions on the core means, the toner zone is at the 12 o'clock position on the core means, and the removal means is at the 4 o'clock position on the core means.

15. Apparatus in an electrostatographic reproduction machine for controlling developer traveling to a toning zone for transferring toner to a latent image on a moving electrostatic image-bearing member from a feed zone wherein the developer with toner is added to the apparatus, said apparatus comprising:

shell means having an outer wall surface for supporting the developer; and core means mounted for rotation in said shell means and having magnetic means for generating magnetic flux densities to attract the developer to said shell means, the shell means and the core means being separated by a shell-to-core clearance;

wherein the shell-to-core clearance is set according to the magnetic strength of said core means for said shell means to hold only the proper amount of the developer so that an appropriate amount of toner is applied to the electrostatic image bearing member and there is no roll-back of developer at the toning zone, and the shell-to-core clearance having a clearance point of minimum magnetic flux density between the feed zone and the toning zone wherein excess developer is discharged from said shell means to achieve said proper amount.

* * * * *